US009919883B2

(12) United States Patent
Fuse

(10) Patent No.: US 9,919,883 B2
(45) Date of Patent: Mar. 20, 2018

(54) SHEET FEEDING DEVICE AND IMAGE FORMING DEVICE

(71) Applicant: CANON KABUSHIKI KAISHA, Tokyo (JP)

(72) Inventor: Yasuhiko Fuse, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/339,618

(22) Filed: Oct. 31, 2016

(65) Prior Publication Data

US 2017/0131675 A1 May 11, 2017

(30) Foreign Application Priority Data

Nov. 5, 2015 (JP) ..... 2015-217439

(51) Int. Cl.

| | |
|---|---|
| ***B65H 1/08*** | (2006.01) |
| ***B65H 1/26*** | (2006.01) |
| ***B65H 1/04*** | (2006.01) |
| ***B65H 1/14*** | (2006.01) |
| ***G03G 15/00*** | (2006.01) |

(52) U.S. Cl.

CPC ..... *B65H 1/266* (2013.01); *B65H 1/04* (2013.01); *B65H 1/14* (2013.01); *G03G 15/6511* (2013.01); *B65H 2403/61* (2013.01); *B65H 2513/222* (2013.01); *B65H 2515/322* (2013.01); *B65H 2801/12* (2013.01)

(58) Field of Classification Search

CPC . B65H 1/08; B65H 1/14; B65H 1/266; B65H 2403/60; B65H 2403/61; B65H 2403/725; B65H 2513/22; B65H 2513/222; B65H 2515/322

See application file for complete search history.

(56) References Cited

U.S. PATENT DOCUMENTS

| | | | | |
|---|---|---|---|---|
| 2003/0089574 | A1* | 5/2003 | Chen | F16D 43/18 192/105 CD |
| 2003/0091378 | A1* | 5/2003 | Yang | B65H 1/12 400/718 |
| 2007/0181579 | A1* | 8/2007 | Kuo | B65F 1/163 220/264 |
| 2011/0241285 | A1* | 10/2011 | Sekiguchi | B65H 1/14 271/162 |
| 2013/0069302 | A1* | 3/2013 | Naoi | B65H 1/14 271/126 |

(Continued)

FOREIGN PATENT DOCUMENTS

JP 8-127434 A 5/1996

OTHER PUBLICATIONS

Merriam-Webster online dictionary: https://www.merriam-webster.com/dictionary/member, definition 4.*

*Primary Examiner* — Prasad V Gokhale

(74) *Attorney, Agent, or Firm* — Canon U.S.A., Inc. IP Division

(57) ABSTRACT

A lifter gear that is engaged with a drive gear when a sheet feeding cassette is mounted, and that releases the engagement with the drive gear when the sheet feeding cassette is dismounted, wherein when the engagement with the drive gear is released and when the lift plate is lowered, braking force caused by frictional force is applied to the lifter gear from a brake unit and a buffer member absorbs force exerted to the lifter gear.

10 Claims, 11 Drawing Sheets

(56) References Cited

U.S. PATENT DOCUMENTS

| | | | | |
|---|---|---|---|---|
| 2014/0284874 | A1* | 9/2014 | Hayayumi | B65H 1/025 271/157 |
| 2014/0346728 | A1* | 11/2014 | Fuda | B65H 1/14 271/147 |
| 2015/0084270 | A1* | 3/2015 | Lo | B65H 1/14 271/147 |
| 2015/0108713 | A1* | 4/2015 | Yoshitsugu | B65H 31/08 271/217 |

* cited by examiner

SHEET FEEDING DEVICE AND IMAGE FORMING DEVICE

BACKGROUND

Field of the Disclosure

The present disclosure relates to a sheet feeding device and an image forming device, and in particular relates to the same provided with a sheet stacking member that is capable of being lifted and lowered and that stacks sheets on a sheet containing unit.

Description of the Related Art

Conventional image forming devices, such as printers, copiers, and facsimiles, include a sheet feeding device that feeds sheets that is contained in a sheet containing unit provided detachably to a main body of the device to an image forming unit by sending out the sheets with a sheet feeding unit. In the sheet feeding device, a lift plate that is a sheet stacking member on which the sheets are stacked is provided, so as to be capable of being lifted and lowered, in a sheet feeding cassette that is the sheet containing unit. When feeding the sheets, the lift plate is lifted such that the sheets are urged against a sheet feeding roller that is a sheet feeding unit. Furthermore, by having the sheet be in pressure contact with the feed roller, pressure contact force (hereinafter, referred to a sheet feeding pressure) is generated, and in a state in which the sheet feeding pressure is generated, the sheet feeding roller is rotated to send the sheets out.

Such a sheet feeding device is provided in the sheet feeding cassette with a lifter mechanism that is a lifting and lowering mechanism for lifting the lift plate, a gear and a motor that drives the gear is included in the main body of the device, and a drive unit that drives the lifter mechanism is provided. Furthermore, when the sheet feeding cassette is mounted, the lifter mechanism is connected to the drive unit, and subsequently, when the drive unit is driven, the lift plate is lifted with the lifter mechanism to a predetermined height that enables the sheet on the top to be sent out.

Incidentally, when replenishing the sheets, when changing the type of sheet, or when a sheet jam occurs, the sheet feeding cassette is drawn out from the main body of the device. When the sheet feeding cassette is drawn out as above, the connection between the lifter mechanism and the drive unit is released. In such a case, when the lift plate is in a lifted state, the lift plate is lowered by its own weight and the weight of the stacked sheets, and impacts the bottom surface of the sheet feeding cassette generating a noise with the impact. Note that the loudness of the sound of impact is prominent when there are no sheets stacked, in other words, when the sheet feeding cassette is drawn out when the lift plate is at its highest position.

Accordingly, in Japanese Patent Laid-Open No. 8-127434, in order to mitigate the sound of impact when the lift plate is lowered, for example, a damper is disposed inside a lifting and lowering mechanism and the lift plate is lowered slowly.

Note that in recent years, a need for sheet feeding devices to become more compact and to have a larger capacity is increasing. However, when a damper is disposed in the lifting and lowering mechanism, it makes it difficult to make the sheet feeding device more compact and the structure becomes complex, and further, since there will be a load caused by the damper when lifting the lift plate, load to the motor of the drive unit becomes larger.

SUMMARY

Accordingly, the present disclosure has been made in view of the present situation described above, and an object thereof is to provide, in a simple manner and at a low cost, a sheet feeding device and an image forming device that are capable of reducing the impact made when the lift plate (sheet stacking member) falls. The present disclosure provides a sheet feeding device including, a sheet containing unit detachably provided in a main body of the device, the sheet containing unit including a sheet stacking member on which a sheet is stacked, the sheet stacking member being capable of being lifted and lowered, a drive unit provided in the main body of the device, the drive unit including a drive gear and a driving source that drives the drive gear, a lifting unit that includes a pivoting member capable of pivoting in a direction in which the sheet stacking member is lifted and lowered, and a drive transmission gear connected to the pivoting member, the drive transmission gear being engaged with the drive gear when the sheet containing unit is mounted and releasing engagement with the drive gear when the sheet containing unit is dismounted, the lifting unit lifting the sheet stacking member to a first position, a brake unit that applies a braking force generated by frictional force to the drive transmission gear in a case in which the engagement between the drive gear and the drive transmission gear is released and the sheet stacking member is lowered from the first position, and a buffer member that absorbs force exerted to the drive transmission gear when the engagement between the drive gear and the drive transmission gear is released and the sheet stacking member is lowered.

Further features of the present disclosure will become apparent from the following description of exemplary embodiments with reference to the attached drawings.

DESCRIPTION OF THE EMBODIMENTS

Description of the Embodiments

Figure 1:
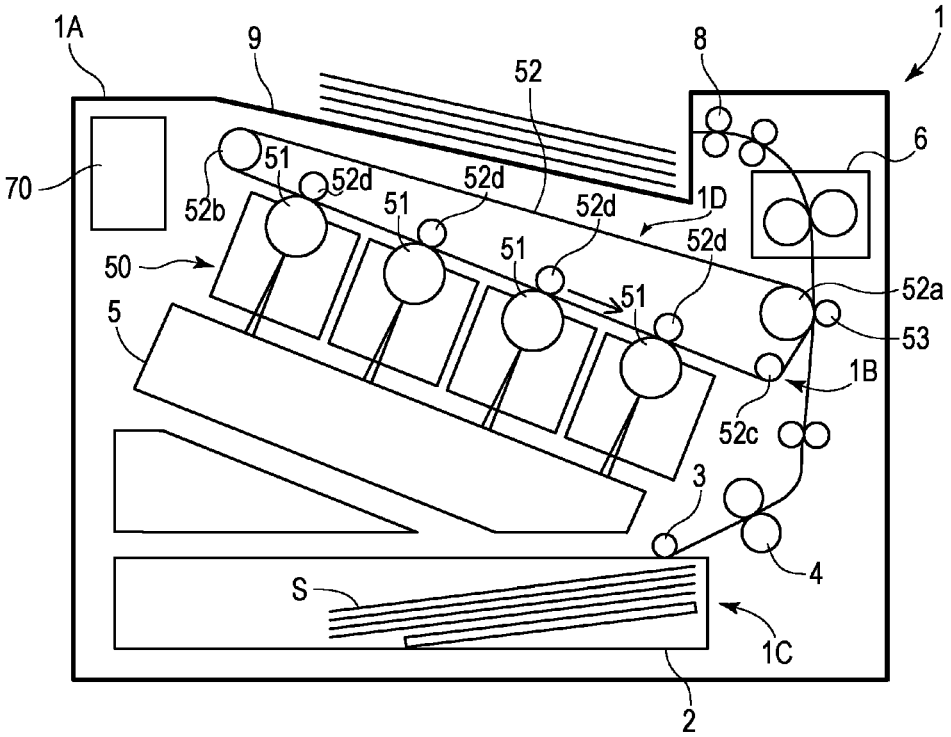
FIG. 1 is a diagram illustrating a schematic configuration of a laser printer that is an example of an image forming apparatus including a sheet feeding device according to a first embodiment of the present disclosure.

Hereinafter, exemplary embodiments of the present discloser will be described in detail with reference to the drawings. FIG. 1 is a diagram illustrating a schematic configuration of a laser printer that is an example of an image forming apparatus including a sheet feeding device according to a first exemplary embodiment of the present disclosure. A laser printer 1 includes, inside a laser printer main body (hereinafter, referred to as a printer main body) 1A, an image forming unit 1B that forms an image on a sheet S and a sheet feeding device 1C that feeds the sheet S.

The image forming unit 1B includes a scanner unit 5, and four process cartridges 50 that form toner images of four colors, namely, yellow (Y), magenta (M), cyan (C) and black (Bk) and that include photosensitive drums 51. Furthermore, the image forming unit 1B includes an intermediate transfer unit 1D disposed above the process cartridges 50. The intermediate transfer unit 1D includes an intermediate transfer belt 52 wound around a drive roller 52*a*, a tension roller 52*b*, a driven roller 52*c*.

Furthermore, the intermediate transfer unit 1D includes primary transfer rollers 52*d* that are provided on the inner side of the intermediate transfer belt 52 and that abut against the intermediate transfer belt 52 at positions opposing the photosensitive drums 51. The intermediate transfer belt 52 is configured of a film-like member, is disposed so as to be in contact with the photosensitive drums 51, and is rotated in an arrow direction with the drive roller 52*a* driven by a drive unit (not shown).

By applying a transfer bias having a positive polarity to the intermediate transfer belt 52 with the primary transfer rollers 52*d*, toner images of various colors on the photosensitive drums 51, the toner images each having a negative polarity, are sequentially transferred in a superposed manner onto the intermediate transfer belt 52. Note that a secondary transfer roller 53 that transfers a full color image formed on the intermediate transfer belt 52 on the sheet S is provided at a position opposing the drive roller 52*a* of the intermediate transfer unit 1D. Furthermore, a fixing unit 6 is disposed above the secondary transfer roller 53.

The sheet feeding device 1C includes a sheet feeding cassette 2 serving as a sheet containing unit in which the sheets S are stacked, and a pickup roller 3 serving as a sheet feeding unit for sending out the sheets S stacked and contained in the sheet feeding cassette 2. Note that an image forming operation of the image forming unit 1B and a sheet feeding operation of the sheet feeding device 1C are controlled with a CPU 70 serving as a control member.

An image forming operation of the laser printer 1 configured in the above manner will be described next. When an image forming operation is started, the scanner unit 5 emits a laser beam according to image information from, for example, a personal computer (not shown) and sequentially exposes surfaces of the photosensitive drums 51, the surfaces of which are uniformly charged to a predetermined polarity and potential, to form electrostatic latent images on the photosensitive drums 51. Subsequently, the electrostatic latent images are developed and visualized with toner, and the visualized toner images are transferred onto the intermediate transfer belt 52 in a superposed manner with a primary transfer bias applied to the primary transfer rollers 52*d*. With the above, a full color toner image is formed on the intermediate transfer belt 52.

Furthermore, in parallel with the operation of forming the toner images, the sheet feeding device 1C sends out a sheet S that is contained in the sheet feeding cassette 2, and after the sheet S has been conveyed with a conveyance roller 4, the sheet S is conveyed to the secondary transfer unit. The full color toner image is transferred, with a secondary transfer bias that has been applied to the secondary transfer roller 53, onto the sheet S that has been conveyed to the secondary transfer unit. Subsequently, the sheet S onto which the full color toner image has been transferred is conveyed to the fixing unit 6. Heat and pressure is applied to the sheet S in the fixing unit 6 such that the toner of various colors are melted and mixed and are fixed as a full color image on the sheet S. After the above, the sheet S on which the image has been transferred is discharged to an output tray 9 with a pair of discharge rollers 8 provided downstream of the fixing unit 6.

Figure 2:
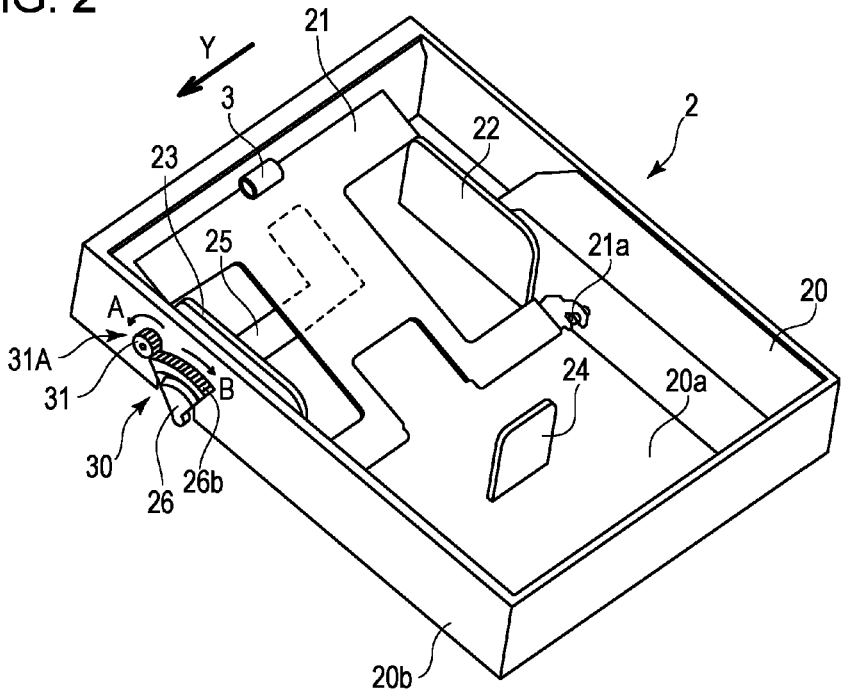
FIG. 2 is a perspective view a sheet feeding cassette of the laser printer, according to an embodiment of the present disclosure.

Referring to FIG. 2, description of the sheet feeding cassette 2 will be given next. The sheet feeding cassette 2 is capable of containing sheets of variety of sizes, such as an A6 size to an LGL size. Furthermore, the sheet feeding cassette 2 is mounted in a mount space (not shown) provided in a lower portion of the printer main body 1A serving also as a sheet feeding device body, so as to be capable of being drawn out (so as to be detachable) in a width direction orthogonal to a sheet feed direction.

The sheet feeding cassette 2 includes a cassette main body 20 that contains the sheets S, and a pair of front lateral side restriction member 22 and back lateral side restriction member 23 that are provided in the cassette body 20 so as to be movable in the width direction and that serve as a pair of restriction member that restricts positions of lateral edges of the sheets S in the width direction. The front lateral side restriction member 22 and the back lateral side restriction member 23 are connected with a rack portion and a pinion gear (both not shown). Furthermore, when a user operates a lever (not shown) provided in the front lateral side restriction member 22, the front lateral side restriction member 22 and the back lateral side restriction member 23 move in the width direction in an interlocked manner and are disposed at positions corresponding to the sheet size.

The sheet feeding cassette 2 includes a rear end restriction member 24 that is provided in the cassette main body 20 so as to be capable of moving in the sheet feed direction and that restricts the positions of the rear ends of the sheets S, which are the upstream ends of the sheets S in the sheet feed direction. The rear end restriction member 24 is capable of being slid in the sheet feed direction. When the user operates a lever (not shown) of the rear end restriction member 24, the sheets S are disposed at positions that correspond to the sheet size.

The sheet feeding cassette 2 includes a lift plate 21 serving as a sheet stacking member supported by the cassette main body 20 so as to be pivotal (so as to be capable of being raised and lowered) in an up-down direction. The downstream end side of the lift plate 21 pivots in the up-down direction about supports 21*a* provided in the cassette main body 20. Note that in FIG. 2, only one of the supports 21*a* is illustrated.

In a portion between a bottom surface 20*a* of the cassette main body 20 and the lift plate 21, a lifter plate 25 serving as a pivoting member that pushes up the lift plate 21 towards the pickup roller 3 is disposed in a pivotal manner in the up-down direction that is a direction in which the lift plate 21 is raised and lowered. The pivoting edge of the lifter plate 25 is in contact with a back side of the lift plate 21 at a middle portion of the lift plate 21.

A lifter gear 26 serving as a fan-shaped drive transmission gear in which a teeth portion 26*b* is formed in the peripheral surface thereof is attached downstream of (hereinafter, referred to as a back side) of the lifter plate 25 in a cassette mounting direction illustrated by an arrow Y. Furthermore, the lifter plate 21 pivots integrally with the lift gear 26 about a lifter shaft 26*x* that is a shaft of the lifter gear 26 serving as a pivot axis illustrated in FIG. 6B.

A drive gear 31 that engages with the lift gear 26 when the sheet feeding cassette 2 is mounted is provided in the mount space and on the back side of the printer main body 1A. The drive gear 31 is driven (actuated) with a lifter motor 500 described above, illustrated in FIG. 3, serving as a driving source provided in the printer main body 1A. In the present exemplary embodiment, a drive unit 31A includes the lifter motor 500 and the drive gear 31.

In a state in which the drive gear 31 is engaged with the lifter gear 26, when the drive gear 31 is driven with the lifter motor 500 and is rotated in an arrow A direction, the lifter gear 26 is rotated in an arrow B direction. When the lifter plate 25 interlocked with the rotation of the lifter gear 26 pivots upwards about the lifter shaft 26*x*, the lift plate 21 is lifted and the sheets S stacked on the lift plate 21 is brought into pressure contact with the pickup roller 3. As described above, in the present exemplary embodiment, a lifting unit 30 that pushes up the lift plate 21 and brings the sheets S stacked on the lift plate 21 into pressure contact with the pickup roller 3 includes the lifter plate 25 and the lifter gear 26 that engages with the drive gear 31. Furthermore, the lift plate 21 can be lifted with the lifting unit 30 to a position (a first position) where the pickup roller 3 is capable of feeding the sheets S.

Note that when the sheet feeding cassette 2 is drawn out, the engagement (connection) between the lifter gear 26 and the drive gear 31 is released. When the engagement with the drive gear 31 is released in the above manner, the lifter gear 26 can rotate freely. With the above, for example, in a case in which the sheets S are stacked, when the sheet feeding cassette 2 is drawn out while the lift plate 21 is pivoting upwards, the lifter plate 21 becomes lowered with the weight of the sheets S and the lift plate 21 itself while the lifter gear 26 rotates freely, and in a case in which no sheet S is stacked, when the sheet feeding cassette 2 is drawn out while the lift plate 21 is pivoting upwards, the lifter plate 21 becomes lowered with the weight of the lift plate 21 itself while the lifter gear 26 rotates freely.

Figure 3:
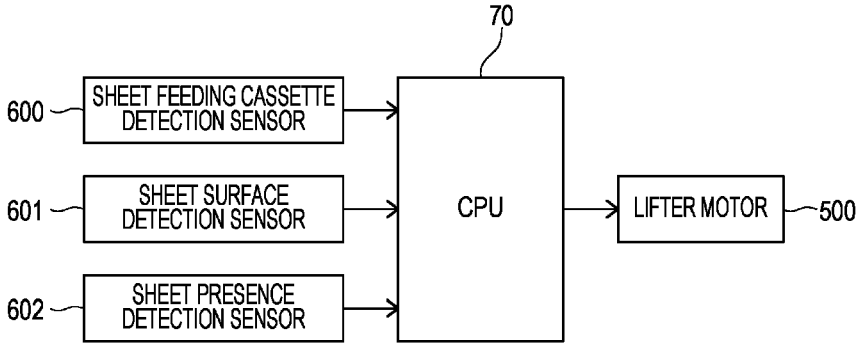
FIG. 3 is a control block diagram of the sheet feeding device, according to an embodiment of the present disclosure.

FIG. 3 is a control block diagram of the sheet feeding device 1C, and as illustrated in FIG. 3, a sheet feeding cassette detection sensor 600 that detects that the sheet feeding cassette has been accommodated in the mount space of the printer main body 1A is connected to the CPU 70. Furthermore, as described later and as illustrated in FIGS. 5A and 5B, a sheet surface detection sensor 601 the detects the stacked height of the sheets S, a sheet presence detection sensor 602 that is a detection member that detects whether there is a sheet S in the sheet feeding cassette, and a lifter motor 500 are connected to the CPU 70.

Figure 4A:
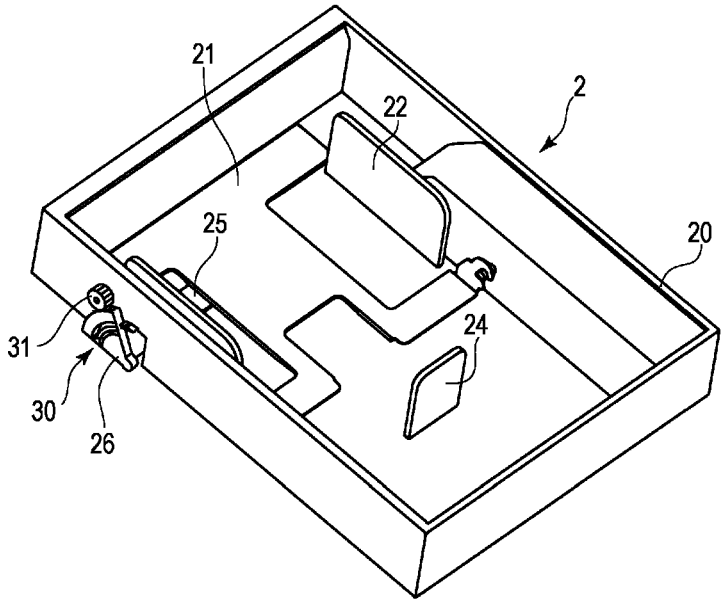
FIG. 4A is a perspective view illustrating a state in which the lift plate of the sheet feeding cassette is lowered to a position allowing the sheet to be stacked, according to an embodiment of the present disclosure.

An operation of the lifting unit 30 will be described next. Note that the user draws out the sheet feeding cassette 2 from the printer main body 1A when installing the sheets S in the sheet feeding cassette 2. FIG. 4A illustrates a state in which the sheet feeding cassette with no sheets therein is drawn out from the printer main body 1A. In such a state, the lift plate 21 is lowered to a position where the sheets S can be stacked thereon.

Figure 4B:
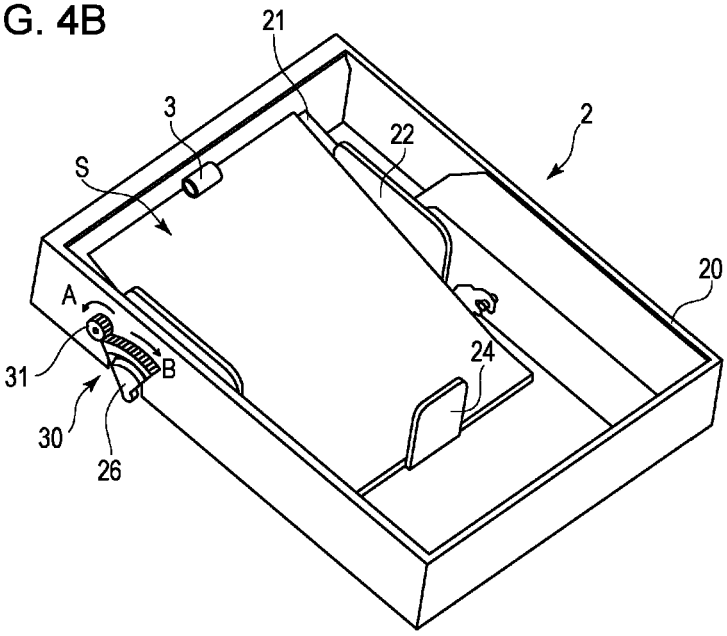
FIG. 4B is a perspective view illustrating a state in which the lift plate is pivoted upwards, according to an embodiment of the present disclosure.

When the user stacks the sheets S on the lift plate 21 of the sheet feeding cassette 2 and, subsequently, when the user returns the sheet feeding cassette 2 into the printer main body 1A, as it has been described already, the drive gear 31 becomes engaged with the lifter gear 26 of the sheet feeding cassette 2. When the sheet feeding cassette detection sensor 600 detects that the sheet feeding cassette 2 has been mounted in the mount space, the CPU 70 drives the lifter motor 500. With the above, as illustrated in FIG. 4B, the drive gear 31 rotates in the arrow A direction and upon rotation of the drive gear 31, the lifter gear 26 engaged with the drive gear 31 rotates in the arrow B direction.

Figure 5A:
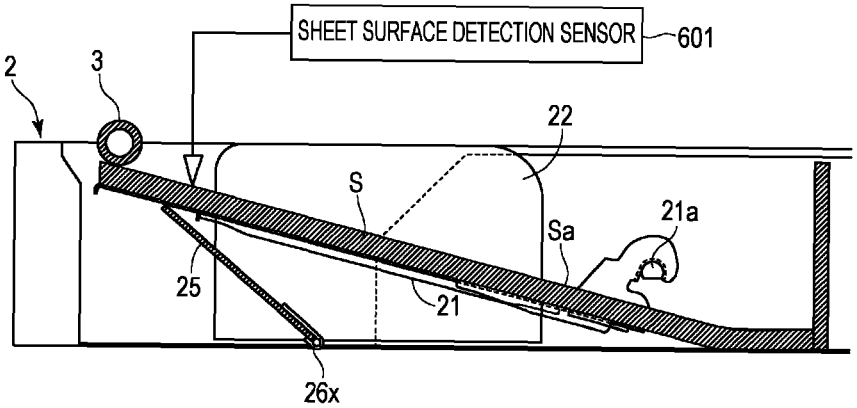
FIG. 5A is cross-sectional view illustrating a state in which the sheets are stacked on the lift plate, according to an embodiment of the present disclosure.
Figure 5B:
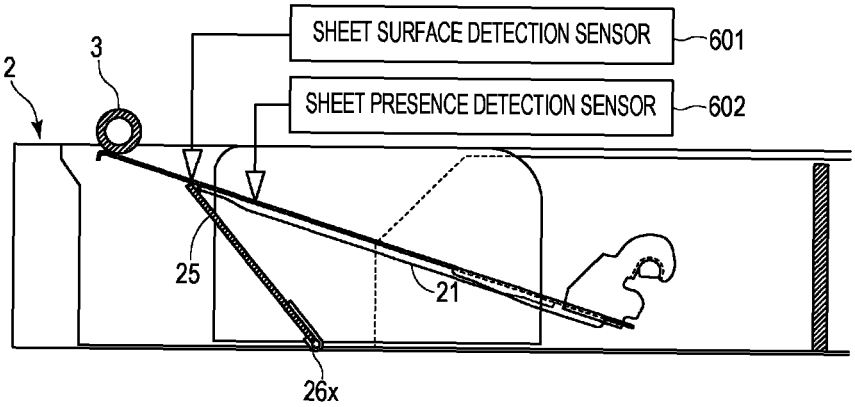
FIG. 5B is a cross-sectional view illustrating a state in which there is not sheet left on the lift plate, according to an embodiment of the present disclosure.

As illustrated in FIG. 5A, the lifter plate 25 pivots upwards about the lifter shaft 26*x* with the rotation of the lifter gear 26. With the pivoting of the lifter plate 25, the lift plate 21 pivots upwards about the supports 21*a* to a position in which the sheet surface detection sensor 601 detects the sheets S on the lift plate 21. Subsequently, when the lift plate 21 pivots further upwards to a position in which the sheets S can be fed with the pickup roller 3, the CPU 70 stops the lifter motor 500. In the above manner, the sheets S are set to be in contact at a predetermined sheet feeding pressure with the pickup roller 3.

Subsequently, the CPU 70 drives the pickup roller 3 and, the sheets S are sent out in a sequential manner from the sheet Sa on the top. Note that when the sheets S are sent out in the above manner, the sheets S stacked on the lift plate 21 decreases and the stacked height of the sheets S stacked on the lift plate 21 becomes lower. The CPU 70 monitors the stacked height of the sheets S with the sheet surface detection sensor 601, and when the position of the sheet S on the top falls under a predetermined height, the CPU 70 receiving a signal from the sheet surface detection sensor 601 actuates the lifter motor 500 again. With the above, the lifter plate 25 pivots upwards again, and the lift plate 21 is lifted to a position where the top surface of the sheet S is in contact with the pickup roller 3 at an appropriate sheet feeding pressure.

The sheets S in the sheet feeding cassette is all sent out by repeating the above operation of sending out the sheets S with the pickup roller 3 and the above operation of pivoting the lift plate 21 upwards with the lifting unit 39. When there is no sheets S in the sheet feeding cassette, on the basis of a signal from the sheet presence detection sensor 602 illustrated in FIG. 5B indicating that there is no sheet S left in the sheet feeding cassette, the CPU 70 stops the sheet feeding operation and notifies the user of the above. Based on the notification, the user draws out the sheet feeding cassette 2 from the printer main body 1A to replenish the sheets S, and replenishes the sheets S.

Note that as illustrated in FIG. 5B, the lift plate 21 is pushed up to the top position immediately before the user draws out the sheet feeding cassette 2 from the printer main body 1A. In such a state, when the sheet feeding cassette 2 is drawn out from the printer main body 1A, the engagement between the lifter gear 26 and the drive gear 31 is released and the lifter gear 26 stops supporting the lift plate 21; accordingly, the lift plate 21 is lowered by its own weight.

Figure 6A:
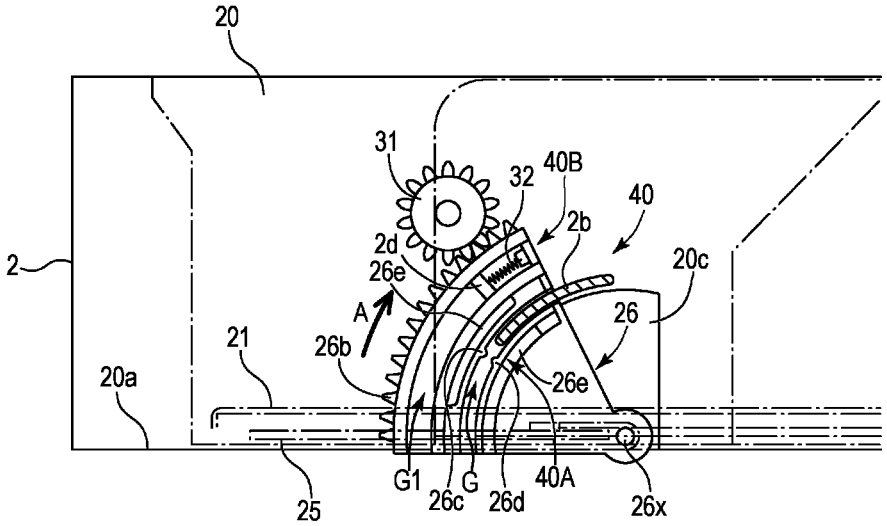
FIG. 6A is a cross-sectional view of an impact mitigating member provided in the sheet feeding device, according to an embodiment of the present disclosure.
Figure 6B:
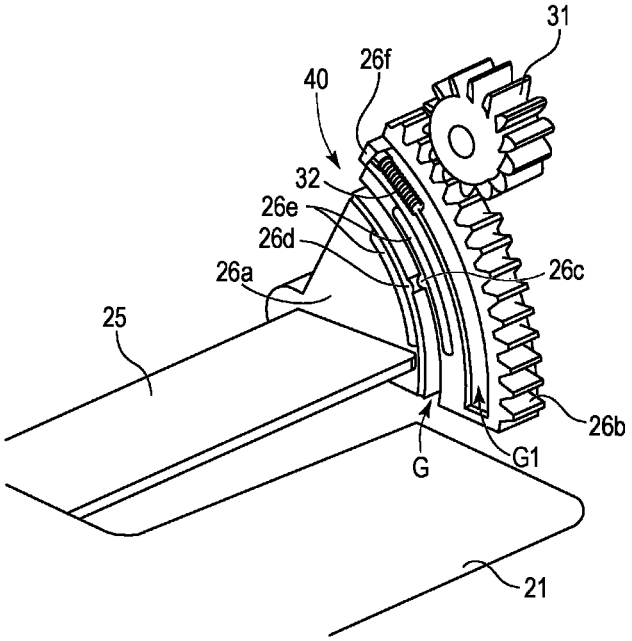
FIG. 6B is a perspective view of the impact mitigating member, according to an embodiment of the present disclosure.

Incidentally, as illustrated in FIGS. 6A and 6B, in the present exemplary embodiment, a groove G that has a shape that is concentric with the lifter shaft 26*x* is formed in a lateral side 26*a* of the lifter gear 26 on the cassette main body side. Furthermore, claws 26*c* and 26*d* that are pressure contact portions are provided so as to oppose each other are formed in the two facing inner wall surfaces of the groove G.

In the present exemplary embodiment, the claws 26*c* and 26*d* are each provided on the backside thereof with a slit hole 26*e* so as to allow a predetermined amount of elastic deformation to occur and are center beamed (bridged across); however, the claws 26*c* and 26*d* may be cantilevered. Furthermore, in the present exemplary embodiment, the interval between the claws 26*c* and 26*d* is about 1.4 mm.

Note that as illustrated in FIG. 6B, in the present exemplary embodiment, the lifter plate 25 is attached to the lateral side 26*a* of the lifter gear 26. Furthermore, as illustrated in FIG. 6A, in such a case as well, an opening portion 20*c* is formed in the back side lateral plate 20*b* of the cassette main body 20 so as to enable the lifter plate 25 to pivot in the up-down direction upon rotation of the lifter gear 26.

Figure 7:
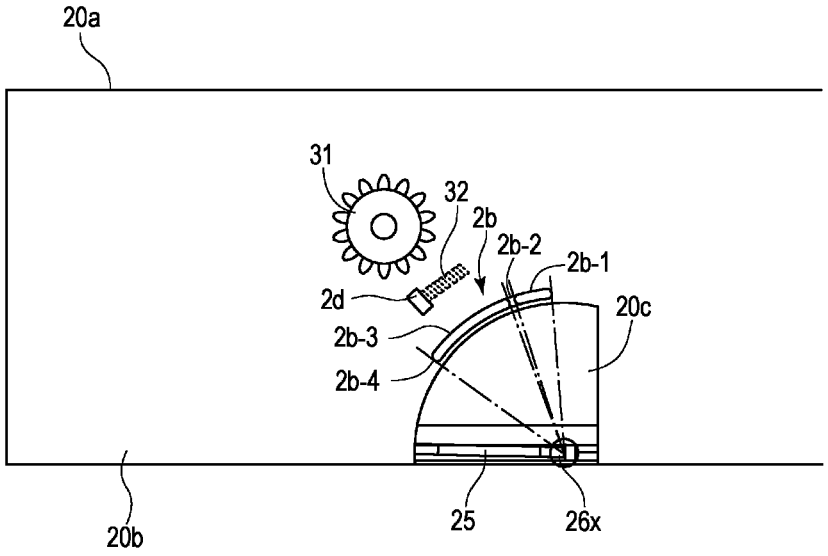
FIG. 7 is side view of a back side lateral plate of a cassette main body of the sheet feeding cassette, according to an embodiment of the present disclosure.

Meanwhile, as illustrated in FIG. 7, a rib 2*b* serving as a pressure contacted portion in which the claws 26*c* and 26*d* (hereinafter, referred to as sliding claws) of the lifter gear 26 slides while being in pressure contact therewith is provided in an outer wall surface of the back side lateral plate 20*b* of the cassette main body 20. The rib 2*b* (hereinafter, referred to as a cassette rib) moves inside the groove G of the lifter gear 26 when the lifter gear 26 rotates.

The cassette rib 2*b* has a shape that is concentric about the lifter shaft 26*x* of the lifter gear 26 so as not to disturb the rotation of the lifter gear 26. Furthermore, the cassette rib 2*b* includes a first portion 2*b*-1 in which a width (thickness) in a radial direction is narrow (thin), a second portion 2*b*-3 that has a wide width in the radial direction, a connection portion 2*b*-2 that connects the first portion 2*b*-1 and the second portion 2*b*-3 that has different widths, and a bevel portion 2*b*-4.

The surfaces of the first portion 2*b*-1, the connection portion 2*b*-2, and the second portion 2*b*-3 of the cassette rib 2*b* constitute sliding surfaces on which the sliding claws 26*c* and 26*d* being in pressure contact therewith slide when the sliding claws 26*c* and 26*d* slide, as described later. Note that in the present exemplary embodiment, in the cassette rib 2*b*, a width (a thickness) of the first portion 2*b*-1 positioned on the upstream side in the rotation direction, that is, on the upstream side in a first direction (a lowering direction) that is a direction in which the lifter gear 26 rotate together with the lift plate 21 when the lift plate 21 is lowered is about 1.4 mm. The width of the second portion 2*b*-3 positioned on the downstream side in the rotation direction of the lifter gear 26, that is, on the downstream side in the first direction is about 2.0 mm.

Figure 11:
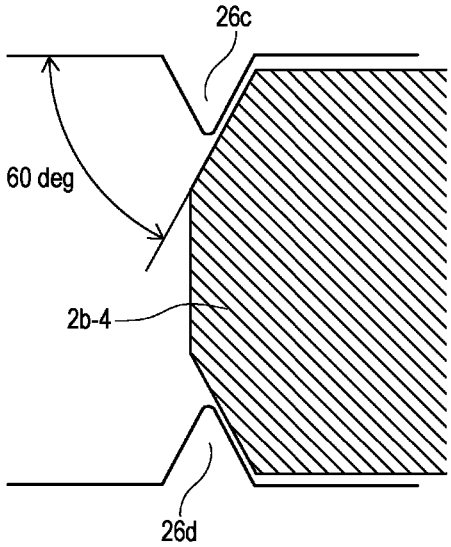
FIG. 11 is a diagram of an enlarged lock portion between the rib of the cassette and a claw of the lifter gear when the lift plate is in a static state, according to an embodiment of the present disclosure.

Furthermore, in the cassette rib 2*b*, a width of a boundary portion between the connection portion 2*b*-2 and the first portion 2*b*-1 is about 1.4 mm, and a width of a boundary portion between the connection portion 2*b*-2 and the second portion 2*b*-3 is about 2.0 mm. The width of the connection portion 2*b*-2 becomes larger towards the second portion 2*b*-3. Note that in the present exemplary embodiment, cassette rib 2*b* has a length that allows the sliding claws 26*c* and 26*d* to pass therethrough before the lift plate 21 reaches the lowest point, as described later. Furthermore, a surface of the bevel portion 2*b*-4 of the cassette rib 2*b* having such a length is provided at an end portion of the second portion 2*b*-3, and as illustrated in FIG. 11 described later, the surface configures a locking surface that locks the claws 26*c* and 26*d* that have passed through the cassette rib 2*b*.

Furthermore, as illustrated in FIGS. 6A and 6B, a spring 32 serving as an elastic member is provided between the lifter gear 26 and the cassette main body 20. Note that in the present exemplary embodiment, as illustrated in FIG. 6B, the spring 32 is provided in the lifter gear 26 while one end of the spring 32 is held by a spring holding portion 26*f* provided in the lifter gear 26.

Furthermore, when the lifter gear 26 rotates, the other end of the spring 32 abuts against a spring holding portion 2*d* provided on the outer wall surface of the back side lateral plate 20*b* of the cassette main body 20 illustrated in FIG. 7. Note that as illustrated in FIG. 6B, a groove G1 into which the spring holding portion 2*d* enters is formed in the lateral side 26*a* of the lifter gear 26. Furthermore, by having the spring holding portion 2*d* enter the groove G1, the other end of the spring 32 can be reliably abutted against the spring holding portion 2*d* when the lift gear 26 is rotated.

Note that the sliding claws 26*c* and 26*d* and the cassette rib 2*b* constitute a brake unit 40A, illustrated in FIG. 6A, which applies braking force caused by frictional force to the lifter gear 26 when the engagement between the drive gear 31 and the lifter gear 26 is released and the lift plate 21 is lowered. Furthermore, the spring 32 that is an elastic member constitutes a buffer member 40B that absorbs the force exerted to the lifter gear 26 when the engagement between the drive gear 31 and the lifter gear 26 is released and the lift plate 21 is lowered.

Furthermore, the brake unit 40A and the buffer member 40B configures an impact mitigating member 40 that mitigates the impact caused when the lift plate 21 is lowered. Note that the sliding claws 26*c* and 26*d*, the cassette rib 2*b*, and the spring 32 are disposed at positions in a rotatable range of the lifter gear 26 where the braking force can act on the lifter gear 26.

Figure 8A:
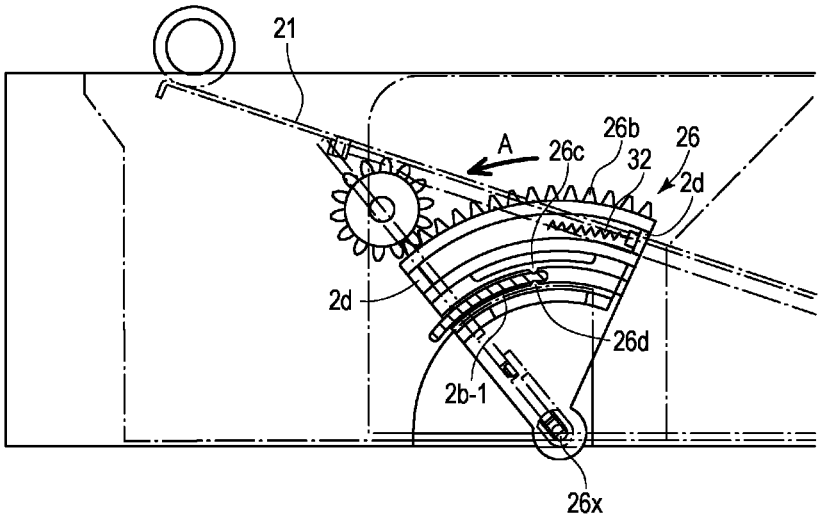
FIG. 8A is a diagram illustrating a state of the impact mitigating member in which the lift plate is lifted to its highest position, according to an embodiment of the present disclosure.

An operation of the impact mitigating member 40 described above will be described next. FIG. 8A illustrates the impact mitigating member 40 in a state in which the lift plate 21 is lifted up to the highest position. In such a state, the sliding claws 26*c* and 26*d* are positioned so as to meet the first portion 2*b*-1 of the cassette rib 2*b*.

However, as it has been described above, since the width of the first portion 2*b*-1 of the cassette rib 2*b* is about 1.4 mm and the interval between the claws is about 1.4 mm, even if the sliding claws 26*c* and 26*d* comes into contact with the cassette rib 2*b*, no frictional force will be generated in the above state. Furthermore, in the above case, the spring holding portion 26*f* of the lifter gear 26 and the spring holding portion 2*d* of the cassette main body 20 are separated from each other at a distance that is larger than the free length of the spring 32. Accordingly, no spring force (elastic force) exerted in a direction restricting the lift plate 21 from being lowered by the spring 32 is generated in the spring 32 provided in the lifter gear 26 such that no force exerted in the direction in which force is applied to the lifter gear 26 is absorbed.

When the sheet feeding cassette 2 is drawn out from the printer main body 1A in the above state, the engagement with the drive gear 31 is released and the lifter gear 26 becomes freely rotatable, such that the lift plate 21 becomes capable of being lowered as well. Note that since there is no frictional force between the sliding claws 26*c* and 26*d* and the cassette rib 2*b* and that the spring 32 exerts no effect immediately after the sheet feeding cassette 2 is drawn out, the lift plate 21 becomes lowered by its own weight, and receiving the load, the lifter gear 26 rotates in the first direction indicated by the arrow A.

Figure 8B:
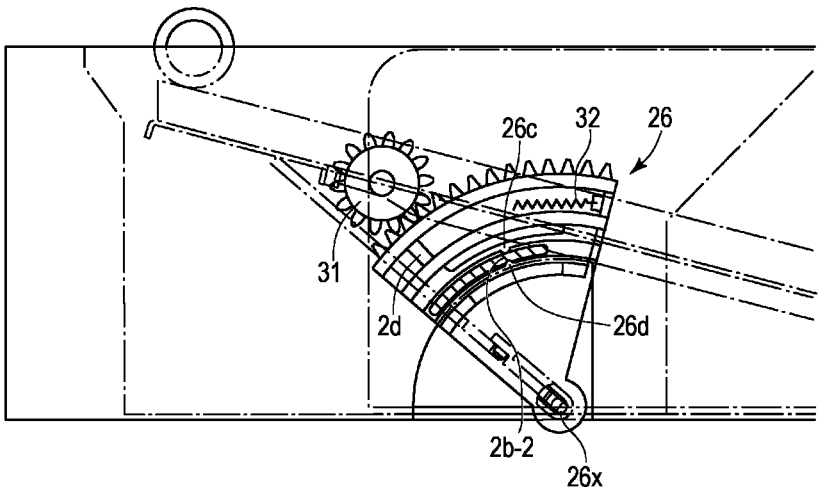
FIG. 8B is a diagram illustrating a state of the impact mitigating member when the lift plate has become slightly lower, according to an embodiment of the present disclosure.

FIG. 8B illustrates the impact mitigating member 40 in a state in which the lift plate 21 is slightly lowered. In such a state, the lifter gear 26 rotates slightly in the first direction, and with the rotation of the lifter gear 26, the sliding claws 26*c* and 26*d* move to a position meeting the connection portion 2*b*-2 of the cassette rib 2*b*. Note that, as described above, the width of the connection portion 2*b*-2 of the cassette rib 2*b* becomes larger towards the second portion. Accordingly, when the lift plate 21 is further lowered, the sliding claws 26*c* and 26*d* pinch the connection portion 2*b*-2 of the cassette rib 2*b* in the radial direction, and subsequently, come into pressure contact with the connection portion 2*b*-2 of the cassette rib 2*b* while becoming bent.

Figure 9:
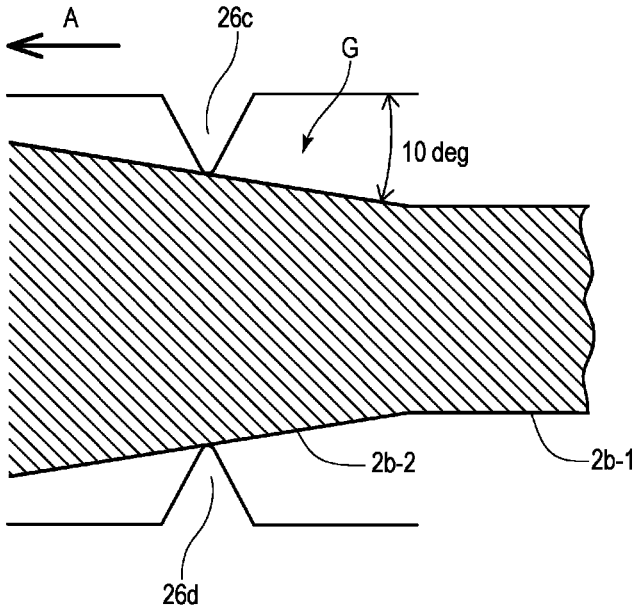
FIG. 9 is a figure illustrating, in an enlarged manner, claws of a lifter gear being in pressure contact with the rib of the cassette main body, according to an embodiment of the present disclosure.

FIG. 9 is a figure illustrating an enlarged state in which the sliding claws 26*c* and 26*d* are in pressure contact with the connection portion 2*b*-2 of the cassette rib 2*b* while being bent. In such a state, when the lifter gear 26 rotates in the arrow direction A illustrated in FIG. 9, with an inclination created by the difference in width of the connection portion 2*b*-2 of the cassette rib 2*b*, the pressure contact force to the connection portion 2*b*-2 of the sliding claws 26*c* and 26*d*. Note that in the present exemplary embodiment, the contact angle between the connection portion 2*b*-2 of the cassette rib 2*b* and the sliding claws 26*c* and 26*d* is 10 degrees.

Furthermore, when the lift plate 21 is lowered, the sliding claws 26*c* and 26*d* pinching the cassette rib 2*b* pass through the connection portion 2*b*-2 of the cassette rib 2*b* and come into pressure contact with a second portion 2*b*-3. With the above, the frictional force between the sliding claws 26*c* and 26*d* and the cassette rib 2*b* becomes the largest and the braking force of the brake unit 40A becomes the largest; accordingly, the lowering speed of the lift plate 21 becomes further slow.

Note that in the present exemplary embodiment, when the sliding claws 26*c* and 26*d* come into pressure contact with the second portion 2*b*-3 of the cassette rib 2*b*, the other end of the spring 32 is locked to the spring holding portion 2*d* of the cassette main body 20 and starts to become compressed. With the above, the force exerted towards the lifter gear 26 starts to become absorbed by the spring 32, and with the function of the spring 32, the lowering speed of the lift plate 21 becomes further slow. In such a state, since the reaction forces of the two sliding claws 26*c* and 26*d* generated when the sliding claws 26*c* and 26*d* are bent are substantially the same in magnitude and are of opposing vectors, the reaction forces become cancelled out such that the bending amount of the sliding claws 26*c* and 26*d* becomes equal as a natural result.

FIG. 6A described above illustrates a state of the impact mitigating member 40 when the lift plate 21 is further lowered, accompanying the lowering of the lift plate 21, the lifer gear 26 rotates a predetermined amount, and the sliding claws 26*c* and 26*d* are detached from the cassette rib 2*b*. In the above, due to the frictional force between the sliding claws 26*c* and 26*d* and the cassette rib 2*b* and due to the function of the spring 32, the lowering speed of the lift plate 21 becomes zero such that the lift plate 21 stops before coming into contact with the bottom surface 20*a* of the cassette main body 20. With the above, contact between the lift plate 21 and the bottom surface 20*a* of the cassette main body 20 can be prevented and generation of an impact sound can be prevented.

In the above, since the sliding claws 26*c* and 26*d* are detached from the cassette rib 2*b*, no frictional force is generated; however, since the amount of compression of the spring 32 is at its largest, force that rotates in the opposite direction (an arrow A' direction) is exerted to the lifter gear 26 with the spring force of the spring 32. In other words, when the lift plate 21 is lowered and the sliding claws 26*c* and 26*d* passes through the cassette rib 2*b*, while the lowering speed of the lift plate 21 becomes zero, a second force that lifts the lift plate 21 in the opposite direction with respect to the first direction is exerted to the lift plate 21 with the spring 32.

Figure 10A:
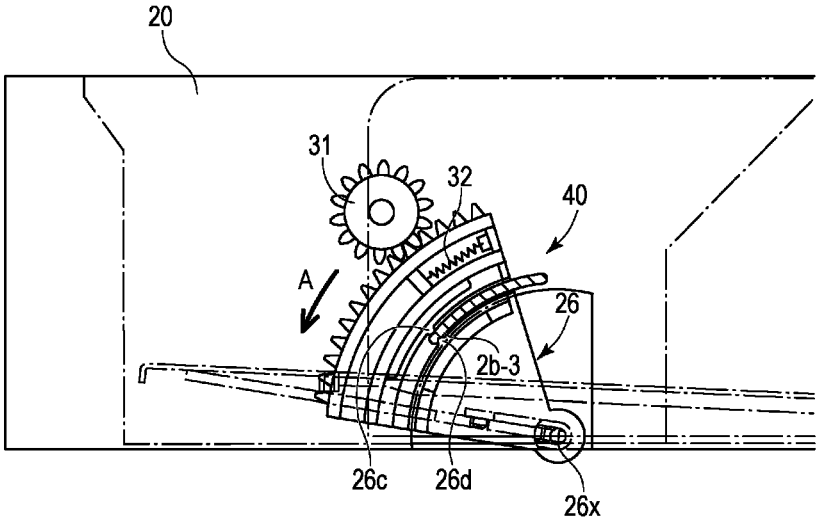
FIG. 10A is a diagram for describing a state of the impact mitigating member when the lift plate has been lowered and stopped at a position allowing the sheet to be stacked, according to an embodiment of the present disclosure.
Figure 10B:
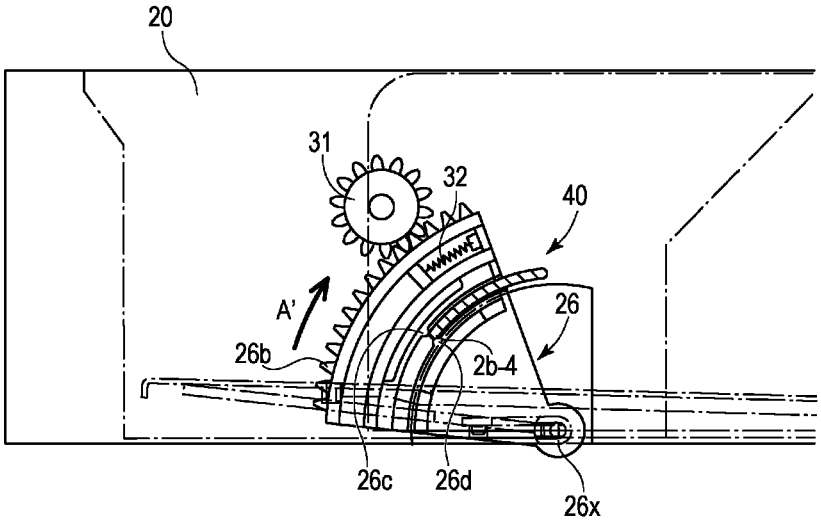
FIG. 10B is a diagram for describing a state of the impact mitigating member in which the lift plate has been lowered to and stopped at a position that enables the sheets to be mounted thereon, according to a first exemplary embodiment of the present disclosure.

FIG. 10B illustrates the impact mitigating member 40 when the lift plate 21 is lowered and stopped at a position where the sheet can be stacked. In such a case, the lifter gear 26 is biased in the second direction illustrated by an arrow A' with the spring 32, and the sliding claws 26*c* and 26*d* are locked to the bevel portion 2*b*-4 serving as a restriction portion of the cassette rib 2*b*. As described above, after the lift plate 21 is lowered and the sliding claws 26*c* and 26*d* are detached from the cassette rib 2*b*, when the lifter gear 26 is biased in the second direction with the spring 32, the sliding claws 26*c* and 26*d* are locked to the bevel portion 2*b*-4.

FIG. 11 is an enlarged figure of the lock portion between the sliding claws 26*c* and 26*d* and the bevel portion 2*b*-4 of the cassette rib 2*b*. In the above, the sliding claws 26*c* and 26*d* are locked to the bevel portion 2*b*-4 at a contact angle of 60 degrees. Note that the contact angle between the bevel portion 2*b*-4 and the claws 26*c* and 26*d* is larger than the contact angle with the connection portion 2*b*-2 in FIG. 9 described above.

As described above, by setting a contact angle, the sliding claws 26*c* and 26*d* and the bevel portion 2*b*-4 can be maintained in a locked state even if the lifter gear 26 is biased towards the arrow A' direction with the spring 32, and the sliding claws 26*c* and 26*d* will not pass through the bevel portion 2*b*-4. With the above, the rotation of the lifter gear 26 is restricted, and the lift plate 21 is maintained at a position in which the sliding claws 26*c* and 26*d* and the bevel portion 2*b*-4 abut against each other and that enable the sheets S to be stacked. Note that desirably, the position is set at a position that allows the maximum number of sheets to be stacked on the lift plate 21.

Subsequently, after the sheets are stacked on the lift plate 21 and the sheet feeding cassette 2 is mounted in the printer main body 1A, the lifter gear 26 engages with the drive gear 31. When the drive gear 31 is rotated in the above state, the lifter gear 26 rotates in the arrow A' direction illustrated in FIG. 10B. When the lifter gear 26 is rotated, with the rotational force of the lifter gear 26 and the spring 32, the sliding claws 26*c* and 26*d* passes through the bevel portion 2*b*-4 while being elastically deformed. Furthermore, with the rotation of the lifter gear 26, as illustrated in FIG. 5A, the lift plate 21 pivots upwards to a position in which the sheet surface detection sensor 601 detects the sheets S on the lift plate 21.

As described above, in the present exemplary embodiment, the lowering speed of the lift plate 21 is decreased with the frictional force caused by sliding between the sliding claws 26*c* and 26*d* and the cassette rib 2*b* and with the elastic force of the spring 32. Note that when, for example, the sliding friction is large, there may be cases in which the lift plate 21 does not become sufficiently lowered when the lowering speed of the lift plate 21 is reduced with only the sliding friction between the sliding claws 26*c* and 26*d* and the cassette rib 2*b*. Furthermore, in a case in which the sliding friction is small, the lowering speed of the lift plate 21 when the sliding claws 26*c* and 26*d* are detached from the cassette rib 2*b* does not become zero such that the lift plate 21 comes into contact with the bottom surface 20*a* of the cassette main body 20 generating an impact sound.

Furthermore, in a case in which the lowering speed of the lift plate 21 is reduced with only the spring 32, due to the release of the compressed spring 32 after the lift plate 21 has been lowered and due to the following repeated compression, reciprocal damping is caused in the lift plate 21 causing a different type of noise, or the appearance may become degraded. Furthermore, when the user stacks the sheet, because the position of the lift plate 21 does not become fixed since the lift plate 21 is made to float with the spring, work efficiency when replenishing the sheets S is disadvantageously decreased.

Conversely, when configured as in the present exemplary embodiment, the lift plate 21 can be lowered without generating an impact sound. Furthermore, after the lift plate 21 has been lowered, by locking the sliding claws 26*c* and 26*d* to the cassette rib 2*b*, occurrence of damage due to reciprocal damping can be prevented; accordingly, reciprocal damping being caused in the lift plate 21 generating a different type of noise and the appearance becoming degraded can be prevented.

As described above, in the exemplary embodiment, braking force created by frictional force is applied to the lifter gear 26 with the brake unit 40A, and the force exerted to the lifter gear 26 is absorbed with the buffer member 40B. With the above, when the lift plate 21 is lowered, the lowering speed of the lift plate 21 can be reduced without using a damper or the like, and the lift plate 21 can be prevented from coming into aggressive contact with the bottom surface of the cassette main body 20. As a result, the impact and the impact sound created when the lift plate 21 falls can be reduced easily with low cost.

Furthermore, even if reaction force of the compressed spring 32 is received after the lift plate 21 has been lowered, by locking the sliding claws 26*c* and 26*d* to the bevel portion 2*b*-4 of the cassette rib 2*b*, the lift plate 21 can be stopped. With the above, the lift plate 21 can be positioned at a position facilitating replenishment of the sheets S when the sheet feeding cassette 2 is drawn out from the printer main body 1A; accordingly, user operability can be improved.

Note that in the present exemplary embodiment, a rib is provided in the cassette main body 20, and claw shapes are provided in the lifter gear 26; however, not limited to the above, the rib may be provided on the lifter gear side, and the elastic claw shapes may be provided on the cassette main body 20 side. In other words, the rib may be provided in either one of the cassette main body 20 and the lifter gear 26, and the claw shapes may be provided on the other one of the cassette main body 20 and the lifter gear 26.

Incidentally, in the present exemplary embodiment, a case in which the claw shapes are slid while in pressure contact with the rib in the radial direction has been described; however, the claw shapes may be slid while in pressure contact with the rib in the axial direction of the shaft of the lifter gear.

Figure 12:
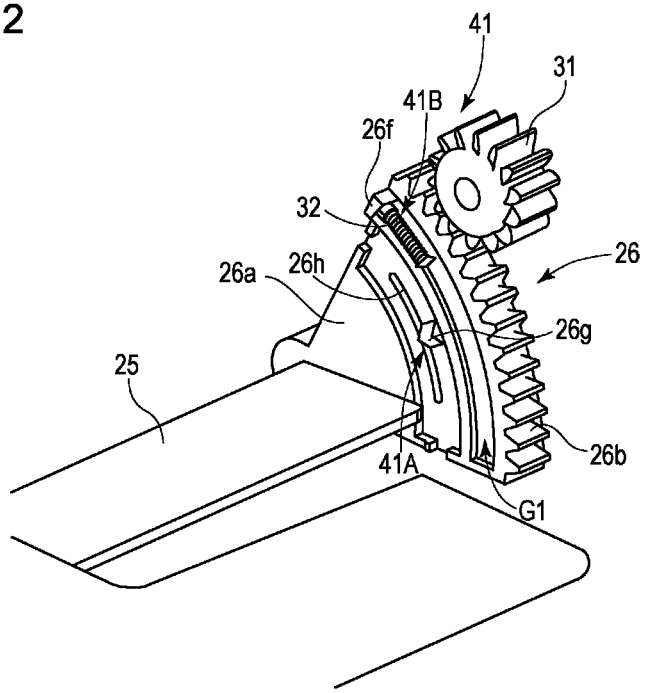
FIG. 12 is a perspective view for describing a configuration of an impact mitigating member of a sheet feeding device according to a second exemplary embodiment of the present disclosure, according to an embodiment of the present disclosure.
Figure 13:
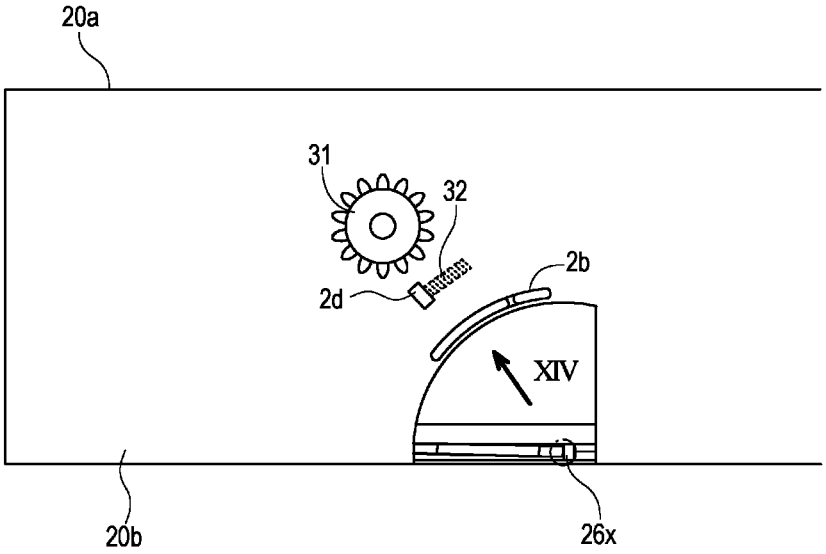
FIG. 13 is a side view of a back side lateral plate of the cassette main body of a sheet feeding cassette, according to an embodiment of the present disclosure.

A second exemplary embodiment of the present disclosure in which the claw shapes are slid while in pressure contact with the rib in the axial direction of the shaft of the lifter gear will be described next. FIG. 12 is a perspective view for describing a configuration of the impact mitigating member of the sheet feeding device according to the present exemplary embodiment, and FIG. 13 is a side view of the back side lateral plate of the cassette main body. Note that in FIGS. 12 and 13, reference numerals that are the same as those in FIGS. 6A to 7 that have already been described are the same or corresponding portions.

As illustrated in FIG. 12, an elastic claw shape 26*g* that is a claw-shaped projection is formed on the lateral side 26*a* that is on the cassette main body side of the lifter gear 26. A slit 26*h* is formed on both sides of the elastic claw shape 26*g* in the radial direction, accordingly, the elastic claw shape 26*g* is capable of elastic deformation in a thrust direction (an axial direction) with respect to the lifter shaft 26*x* of the lifter gear 26. Note that in FIG. 12, a slit on the teeth portion 26*b* side of the lifter gear 26 is not illustrated.

Furthermore, as illustrated in FIG. 13, a cassette rib 2*b* capable of being in pressure contact with the elastic claw shape 26*g* of the lifter gear 26 is provided so as to protrude towards the lifter gear 26 at the outer wall surface of the back side lateral plate 20*b* of the cassette main body 20. Furthermore, in the present exemplary embodiment, a brake unit 41A illustrated in FIG. 12 is constituted by the elastic claw shape 26*g* and the cassette rib 2*b*, and the spring 32 constitute a buffer member 41B illustrated in FIG. 12. Furthermore, the brake unit 41A and the buffer member 41B constitute an impact mitigating member 41.

Figure 14:
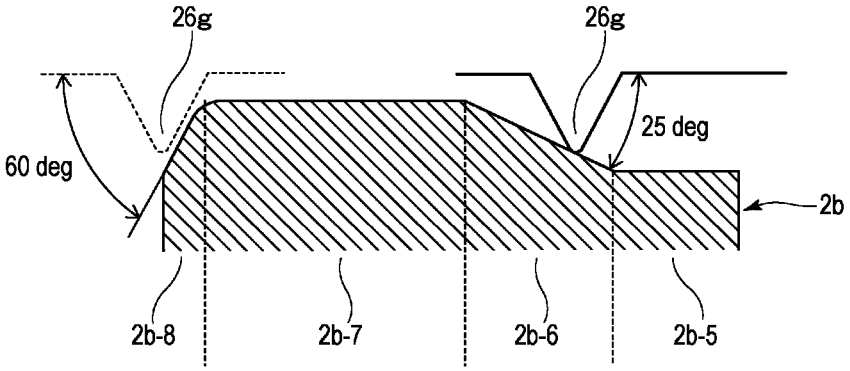
FIG. 14 is a diagram for describing a cam surface of a rib of a cassette, according to an embodiment of the present disclosure.

Note that in the present exemplary embodiment, the cassette rib 2*b*, as illustrated in FIG. 14 that is a diagram taken along XIV-XIV of FIG. 13, includes a first portion 2*b*-5 in which the projection amount in the axial direction, that is, a projection amount towards the lifter gear side, is small, a second portion 2*b*-7 in which the projection amount towards the lifter gear side is large. Furthermore, the cassette rib 2*b* includes a connection portion 2*b*-6 connecting the first portion 2*b*-5 and the second portion 2*b*-7 that have different projection amounts, and a bevel portion 2*b*-8.

In the present exemplary embodiment, surfaces of the first portion 2*b*-5, the connection portion 2*b*-6, and the second portion 2*b*-7 constitute a sliding surface on which the elastic claw shape 26*g* comes in pressure contact. Furthermore, the projection amount of the connection portion 2*b*-6 increases towards the second portion 2*b*-7. In other words, in the cassette rib 2*b*, the gap between the cassette main body 20 and the lifter gear 26 in the axial direction is smaller on the downstream side than the gap on the upstream side in the first direction.

Furthermore, similar to the first exemplary embodiment, the contact angle between the cassette rib 2*b* and the elastic claw shape 26*g* at the connection portion 2*b*-6 is smaller than the contact angle at the bevel portion 2*b*-8 in which the surface thereof constitutes a locking surface. In the present exemplary embodiment, the contact angle between the cassette rib 2*b* and the elastic claw shape 26*g* at the connection portion 2*b*-6 is about 25 degrees, and the contact angle at the bevel portion 2*b*-8 is about 60 degrees. Note that, desirably, the angles are adjusted as appropriate according to the size of the lifter gear, the weight of the lift plate, and the like.

Note that as in the present exemplary embodiment, in a case in which the elastic claw shape 26*g* is slid while in pressure contact with the cassette rib 2*b* in the axial direction of the shaft of the lifter gear 26, a similar effect to that described in the first exemplary embodiment can be obtained. Furthermore, as in the present exemplary embodiment, the elastic claw shape 26*g* may be protruded on the lateral side 26*a* of the lifter gear 26, and the elastic claw shape 26*g* may be configured to slide while being in pressure contact with the cassette rib 2*b* in the axial direction of the lifter gear 26, so as to reduce the size of the lifter gear 26. Furthermore, the projection amount of the cassette rib 2*b* can be reduced. With the above, even in a case in which space is limited, the elastic claw shape and the rib can be formed and reduction in device size can be achieved.

Furthermore, in the description above, a sheet feeding device provided in a laser printer body has been described; however, the sheet feeding device can be applied to a sheet feeding device that is optionally mounted in a laser printer main body as well.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2015-217439, filed Nov. 5, 2015, which is hereby incorporated by reference herein in its entirety.

What is claimed is:

1. A sheet feeding device comprising:

a sheet containing unit detachably provided in a main body of the device, the sheet containing unit including a sheet stacking member on which a sheet is stacked, the sheet stacking member being capable of being lifted and lowered;

a drive unit provided in the main body of the device, the drive unit including a drive gear and a driving source that drives the drive gear;

a lifting unit that includes a pivoting member capable of pivoting in a direction in which the sheet stacking member is lifted and lowered, and a drive transmission gear connected to the pivoting member, the drive transmission gear being engaged with the drive gear when the sheet containing unit is mounted and releasing engagement with the drive gear when the sheet containing unit is dismounted, the lifting unit lifting the sheet stacking member to a first position;

a brake unit that applies a braking force generated by frictional force to the drive transmission gear, the brake unit includes a pressure contacted portion provided in one of the sheet containing unit and the drive transmission gear, and pressure contact portions provided in the other one of sheet containing unit and the drive transmission gear, the pressure contact portions sliding along the pressure contacted portion while in pressure contact with the pressure contacted portion when the drive transmission gear rotates in a lowering direction that is a direction in which the sheet stacking member is lowered; and a buffer member that absorbs force exerted to the drive transmission gear when the engagement between the drive gear and the drive transmission gear is released and the sheet stacking member is lowered.

2. The sheet feeding device according to claim 1, further comprising:

a sheet feeding unit that feeds the sheet stacked on the sheet stacking member, wherein the first position is a position that enables the sheet to be fed with the sheet feeding unit.

3. The sheet feeding device according to claim 1, wherein the buffer member is an elastic member provided between the sheet containing unit and the drive transmission gear.

4. The sheet feeding device according to claim 3, wherein the pressure contacted portion is provided so as to be concentric to a shaft of the drive transmission gear, the pressure contacted portion having a length in which the pressure contact portions pass therethrough before the sheet stacking member reaches a lowest point, and wherein the pressure contacted portion includes a sliding surface on which the pressure contact portions slide while being in pressure contact therewith when the drive transmission gear rotates in the lowering direction, and a locking surface that locks the pressure contact portions that have been biased by the elastic member when the pressure contact portions had passed the pressure contacted portion.

5. The sheet feeding device according to claim 3, wherein the pressure contact portions slides while pinching the pressure contacted portion in a radial direction extending about the shaft of the drive transmission gear.

6. The sheet feeding device according to claim 5, wherein a width of the pressure contacted portion in the radial direction on a downstream side with respect to the rotation direction when the drive transmission gear rotates in the lowering direction is larger than a width of the pressure contacted portion in the radial direction on an upstream side with respect to the rotation direction when the drive transmission gear rotates in the lowering direction, and wherein the pressure contact portions are disposed so as to oppose each other such that an interval between the pressure contact portions in the radial direction is smaller than the width of the pressure contacted portion on the downstream side in the rotation direction.

7. The sheet feeding device according to claim 5, wherein the pressure contact portions are capable of being elastically deformed when pinching the pressure contacted portion.

8. The sheet feeding device according to claim 1, wherein an interval between the pressure contacted portion and the other one of the sheet containing unit and the drive transmission gear on the downstream side with respect to the rotation direction when the drive transmission gear rotates in the lowering direction is smaller than an interval on the upstream side with respect to the rotation direction when the drive transmission gear rotates in the lowering direction.

9. The sheet feeding device according to claim 1, the pressure contact portions are capable of being elastically deformed when in pressure contact with the pressure contacted portion.

10. An image forming device comprising:

an image forming unit that forms an image on a sheet; and the sheet feeding device that feeds the sheet to the image forming unit comprising:

a sheet containing unit detachably provided in a main body of the device, the sheet containing unit including a sheet stacking member on which a sheet is stacked, the sheet stacking member being capable of being lifted and lowered;

a drive unit provided in the main body of the device, the drive unit including a drive gear and a driving source that drives the drive gear;

a lifting unit that includes a pivoting member capable of pivoting in a direction in which the sheet stacking member is lifted and lowered, and a drive transmission gear connected to the pivoting member, the drive transmission gear being engaged with the drive gear when the sheet containing unit is mounted and releasing engagement with the drive gear when the sheet containing unit is dismounted, the lifting unit lifting the sheet stacking member to a first position;

a brake unit that applies a braking force generated by frictional force to the drive transmission gear, the brake unit includes a pressure contacted portion provided in one of the sheet containing unit and the drive transmission gear, and pressure contact portions provided in the other one of sheet containing unit and the drive transmission gear, the pressure contact portions sliding along the pressure contacted portion while in pressure contact with the pressure contacted portion when the drive transmission gear rotates in a lowering direction that is a direction in which the sheet stacking member is lowered; and a buffer member that absorbs force exerted to the drive transmission gear when the engagement between the drive gear and the drive transmission gear is released and the sheet stacking member is lowered.

* * * * *